United States Patent [19]

Biffle

[11] Patent Number: 4,529,210

[45] Date of Patent: Jul. 16, 1985

[54] DRILLING MEDIA INJECTION FOR ROTATING BLOWOUT PREVENTORS

[76] Inventor: Morris S. Biffle, Rte. 3, Box 445D, Midland, Tex. 79701

[21] Appl. No.: 481,328

[22] Filed: Apr. 1, 1983

[51] Int. Cl.[3] ..... E21B 43/00; E21B 33/06

[52] U.S. Cl. ..... 277/31; 251/1.2; 166/387

[58] Field of Search ..... 277/31, 15, 3; 251/1 B; 166/314

[56] References Cited

U.S. PATENT DOCUMENTS

| | | | |
|---|---|---|---|
| 3,529,835 | 9/1970 | Lewis | 277/31 |
| 4,098,341 | 7/1978 | Lewis | 277/31 |
| 4,157,186 | 6/1979 | Murray et al. | 277/31 |

*Primary Examiner*—Robert I. Smith

*Attorney, Agent, or Firm*—Marcus L. Bates

[57] ABSTRACT

Improvements in the operation of a rotating blowout preventor. The rotating head assembly of a rotating blowout preventor includes a stripper rubber which has an upper annular member attached to the lower annular end of a metal support member. The support member extends upwardly into fixed relationship respective to part of the rotating head. The stripper rubber is in the form of an annular body which has an axial passageway formed therethrough for telescopingly receiving a rotating member in sealed relationship therewith. The outer circumferentially extending lower wall surface of the rubber rotatably engages the lower marginal inside wall surface of a fixed washpipe. The present invention provides a positive pressure of drilling media, or drilling media admixed with lubricant, at the interface formed between the outer rubber surface and the inner surface of the washpipe. In another form of the invention, the drilling media flows into the bearing chamber of the rotating head and then into the interface between the rubber and washpipe, so that debris cannot enter either part of the RBOP.

12 Claims, 5 Drawing Figures

DRILLING MEDIA INJECTION FOR ROTATING BLOWOUT PREVENTORS

BACKGROUND OF THE INVENTION

Rotating blowout preventors are known to those skilled in the drilling art, and are usually referred to as RBOP's; or, rotary stripper devices. There is hardly ever a borehole of any significance sunk into the ground without the employment of at least one high pressure rotary stripper device. The RBOP enables a rotating driving member, such as a drill string, or the kelly of a drill string, to be slidably forced axially therethrough. The RBOP includes a stripper rubber assembly rotatably mounted respective to a main body so that the driving member and stripper rubber assembly rotate in low friction relationship respective to the remainder of the RBOP, and at the same time the drill string can be slidably positioned axially respective to the RBOP.

The stripper rubber assembly of the RBOP enables various different sizes of tubular goods to be forced into the borehole and thereafter retrieved from the high pressure interior of the borehole. However, from time to time, a larger or smaller elongated member must be connected within the drill string and placed within the borehole; and, for this and other reasons, the stripper rubber assembly of most all RBOP assemblies is subjected to considerable wear.

RBOP's are usually quite complex, and may include more than a hundred parts. Therefore, the cost of the RBOP usually is directly proportional to its complexity. The RBOP is complex in design because it must be fabricated in such a manner to adequately resist the heavy forces resulting from upthrust and downthrust of the stripper rubber assembly, as well as the lateral forces imposed on the stripper rubber assembly.

Accommodation of the above mentioned forces has been achieved by employing various different large and expensive ball bearings and tapered roller bearing which must be provided with an inside diameter of a size to accommodate the required stripper rubber assembly. The massive bearings require extensive design techniques in order to maintain them in proper operative condition, and in order to achieve a reasonable operational life expectancy. Needless to say, bearings of the required size and design are quite expensive. Accordingly, any improvement which extends the operating life of the RBOP is considered very desirable because of the reduction in cost and because the entire drilling operation relies upon the proper operation of the RBOP.

My previous Patents, U.S. Pat. Nos. 4,154,448; 3,868,832, and 3,724,862 disclose an RBOP which can be advantageously employed as a high pressure rotary stripper. The Murray Patent, U.S. Pat. No. 4,157,186 and the Bunting, et al Patent, U.S. Pat. No. 4,143,880, disclose an RBOP which can also be used in drilling some boreholes. U.S. Pat. Nos. 4,208,056 and 4,367,795 also disclose various different RBOP devices which are advantageously employed during drilling operations. These and other prior art RBOP devices can be used in conjunction with the teachings of the present invention.

The present invention, when used in conjunction with the above mentioned RBOP's, perform more satisfactorily during drilling operations, and the operating cost thereof is appreciably reduced. For this reason, the drilling operation is more dependable because the life of the RBOP is greatly extended by the present invention, and therefore the drilling operation costs are even more reduced because of reduction in downtime.

SUMMARY OF THE INVENTION

Apparatus used in combination with an RBOP by which the life of the RBOP is greatly extended. The prior art RBOP has a main body, an axial passageway extending longitudinally through the main body through which a rotating drive member can be slidably extended. A rubber stripper assembly is rotatably connected to the main body by a journal means so that the stripper assembly is positioned in journaled relationship within the axial passageway by the journal means.

The journal means sealingly resists upthrust and downthrust of the stripper assembly, and also resists lateral forces imposed upon the stripper rubber assembly.

An axial passageway extends through the stripper assembly and is coextensive with the before mentioned axial passageway. A drive member is telescopingly received in sealed relationship through the rubber of the stripper assembly.

The interface located between the outer rotating surface of the stripper rubber and the inner fixed surface of the housing is connected to the drilling media which flows through the rotating driving member, and through the drill string. This provides a positive pressure at the interface which is greater than the pressure effected against the lower surface of the stripper rubber. Consequently, there can never be leakage of the returned drilling material into the critical interface between the stripper rubber and the washpipe. This novel arrangement of the RBOP and drilling media greatly elongates the life of the RBOP and thereby overcomes the major cause of malfunction in the RBOP.

In another form of the invention, the drilling media is admixed with atomized lubricant, conducted into the bearing housing of the stripper assembly, then into the intervening area located between the stripper rubber and the washpipe, thereby providing a positive pressure as well as lubricant at both of two critical areas of operation.

Accordingly, a primary object of the present invention is the provision of an RBOP having a positive pressure applied to the interface located between the stripper rubber and washpipe.

Another object of the present invention is the provision of an RBOP having a drilling media and lubricant injected into the bearing housing and then into the interface formed between the stripper assembly and the interior of the main body.

A still further object of the present invention is to provide an RBOP with a lateral low passageway located within the main body thereof and at a location below the main bearing surface thereof, through which drilling media can flow to the stripper assembly as the assembly is rotated by the driving member.

A further object of this invention is the provision of a system for operating a high pressure rotary stripper which enables the durable life of the stripper rubber assembly thereof to be greatly increased.

A still further object of this invention is the provision of a drilling media injection system for an RBOP which greatly extends the operating life thereof.

Another and still further object of this invention is the provision of apparatus by which a prior art RBOP can be modified to thereby greatly improve the operation thereof.

Another object of this invention is the provision of an RBOP having an injection system for the stripper assembly and bearing housing thereof which improves the reliability thereof.

These and other objects are attained in accordance with the present invention by the provision of a combination of elements which are fabricated in a manner substantially as described and claimed herein.

DETAILED DESCRIPTION OF THE PREFERRED EMBODIMENTS

Figure 1:
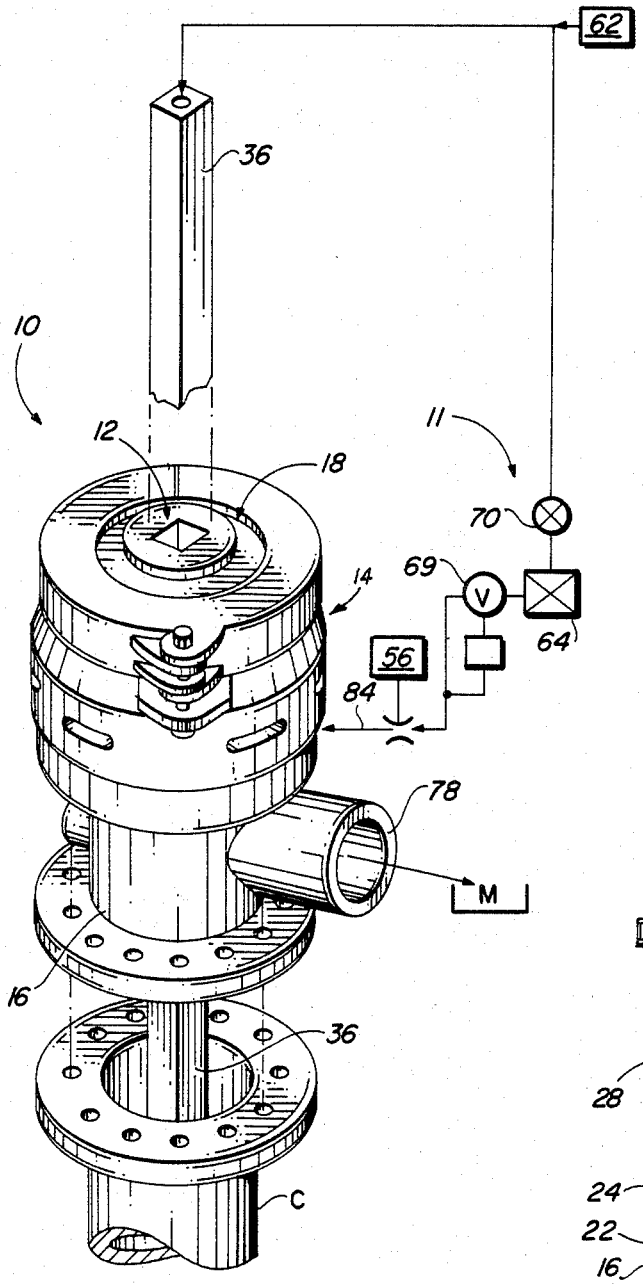
FIG. 1 is a part diagrammatical, part schematical, part perspective view which sets forth an RBOP made in accordance with the present invention.

In the figures of the drawings, and in particular FIG. 1, there is disclosed a system by which a prior art RBOP can be connected to receive flow of drilling media in such a manner that the life expectancy thereof is greatly increased.

Figure 2:
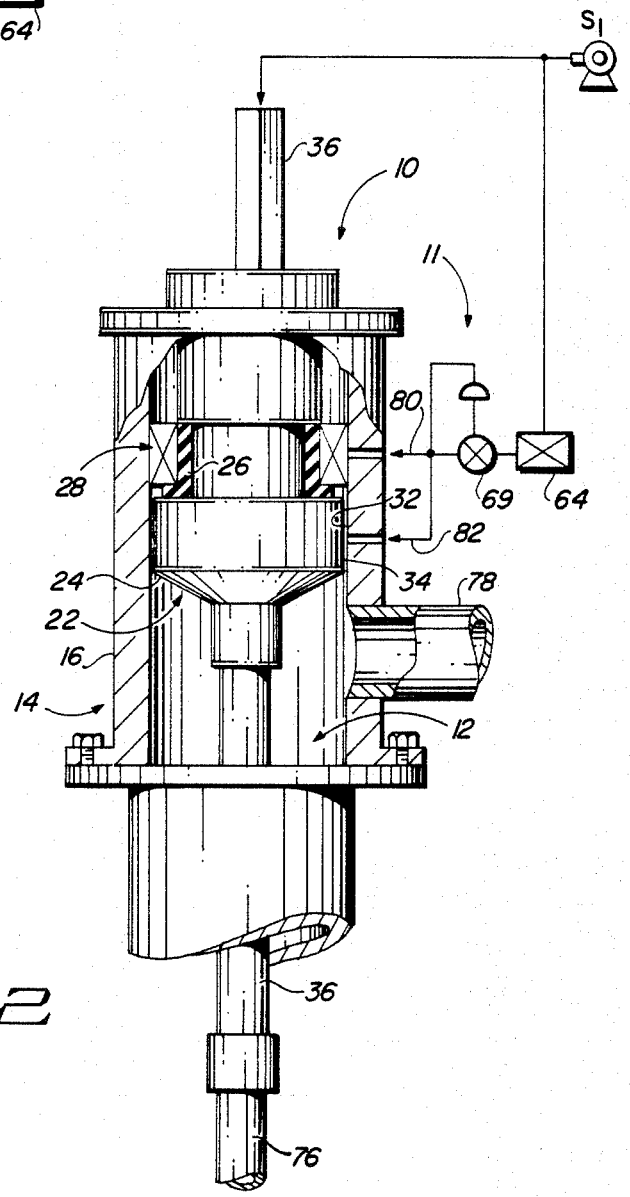
FIG. 2 is a part schematical, part diagrammatical, broken view which broadly illustrates the present invention in conjunction with an RBOP.

In FIGS. 1 and 2, a prior art RBOP 10 is connected to a flow system 11 in a manner whereby contamination of the critical parts of the RBOP with returned formation debris is obviated. As particularly disclosed in FIGS. 2, 3, and 4, the RBOP is seen to include the usual longitudinally extending axial passageway 12 which extends through the main body 14 thereof. The main body includes a main outer housing 16 to which there is affixed a non-rotating inner member 18. The non-rotatable member 18 provides a removable enclosure which supports the rotating head assembly of the RBOP. Numeral 20 broadly indicates the upper end of the RBOP, which usually is in the form of a kelly drive bushing, or the like, for driving the rotating components of the RBOP.

A rotating stripper assembly 22 is received in journaled relationship respective to the main outer housing 16 and the inner member 18. The rotating stripper assembly 22 includes a stripper rubber 24, which preferably is a rubber-like member. The member is vulcanized to a metallic stripper mount 26, so that the stripper rubber can be rotatably disposed within the main body with great structural integrity. The stripper rubber is received in journaled relationship respective to the main housing by the illustrated bearings contained within a bearing chamber 28.

The bearing mounted within the bearing chamber 28 therefore provides the means by which the stripper rubber is received in journaled relationship within the main body.

Bearing means 30 forms one of the before mentioned journal means. Member 31 captures the illustrated bearings within the bearing housing. Washpipe 32 is often in the form of a replaceable sleeve, because, in this preferred embodiment, the sidewalls thereof are continually contacted by the outside diameter 34 of the stripper rubber 24, and forms a seal means therewith.

A rotating driving member 36, usually the kelly, extends along the longitudinal axial passageway of the RBOP and is forced through the stripper rubber interior at 60. Numeral 38 indicates a lateral bearing, while numeral 40 indicates a lower bearing. All bearings 30, 38, and 40 are isolated within the bearing chamber 28. An inwardly directed ledger plate 42 forms a bearing race for each of the bearings 30, 38, and 40, all of which jointly constitute the journal means for the stripper rubber. The bearing housing includes a grease cavity 44, which is formed jointly by rotating member 46 and fixed member 18. A bolt circle 48 connects the rotating stripper assembly 22 to the remainder of the rotating head assembly.

An interface 52 is formed between the interior surface 32 of the main housing, sometimes referred to as the washpipe, and the outer surface 34 of the stripper rubber. An inlet 54 is connected to the bearing housing by utilizing the before mentioned grease cavity, thereby providing a means by which positive pressure can be applied to the interior of the bearing chamber 28. Inlet 54 is connected to flow conduit 55, which is connected to a supply of lubricant 56 by means of the illustrated orifice. The pressure between the inlet 54 and orifice is regulated by means of the illustrated pressure regulator device 69. Seal 58 is oriented to preclude outward flow from grease cavity 44.

Pump 62 illustrates one source of drilling media, which preferably is also the main supply of drilling fluid for the drilling rig associated with the present RBOP. The pump provides flow of drilling media through filter 64 which in turn provides clean drilling media at valve 68. Valve 70 is connected to an alternate source 66 of pressurized fluid, as for example, air at considerable pressure.

Numerals 72, and 74 indicate a groove and seat by which member 18 is secured to member 16 by a clamp device (not shown).

In practicing the method of the present invention, as illustrated in the embodiment set forth in FIG. 2 of the drawings, the drilling media S1 is preferably the compressed air which provides the drilling fluid at kelly 36. The drilling fluid extends downhole through the drill string 76, where the drilling fluid or drilling media returns uphole, bringing formation cuttings therewith, and exits through outflow pipe 78.

Filter 64 is connected to the air supply S1 and provides a clean drilling media supply at valve 69. The flow branches at conduits 80 and 82 so that a first flow of drilling media is available to the bearing chamber, and a second flow of drilling media is available to flow into the interface formed between the stripper rubber and the washpipe.

The first flow of drilling media at 80 provides a positive pressure which precludes ingress of debris into the bearing chamber. Should any leakage of the bearing chamber seal occur, an outward flow of clean, compressed air would occur which would continue to provide some measure of protection to the components housing within the bearing chamber.

The second flow path 82 extends through the main body of the RBOP and communicates with the interface formed by the confronting faces at the exterior of the stripper rubber and the inner peripheral wall surface of the washpipe. The flow must therefore proceed from the interface, downward into the annular area connected to the outflow pipe 78. Accordingly, the positive pressure measured at the interface is greater than the pressure effected within the annular area so that there is always clean compressed air flowing from the interface, which precludes contamination thereof with returned debris from the borehole.

Figure 3:
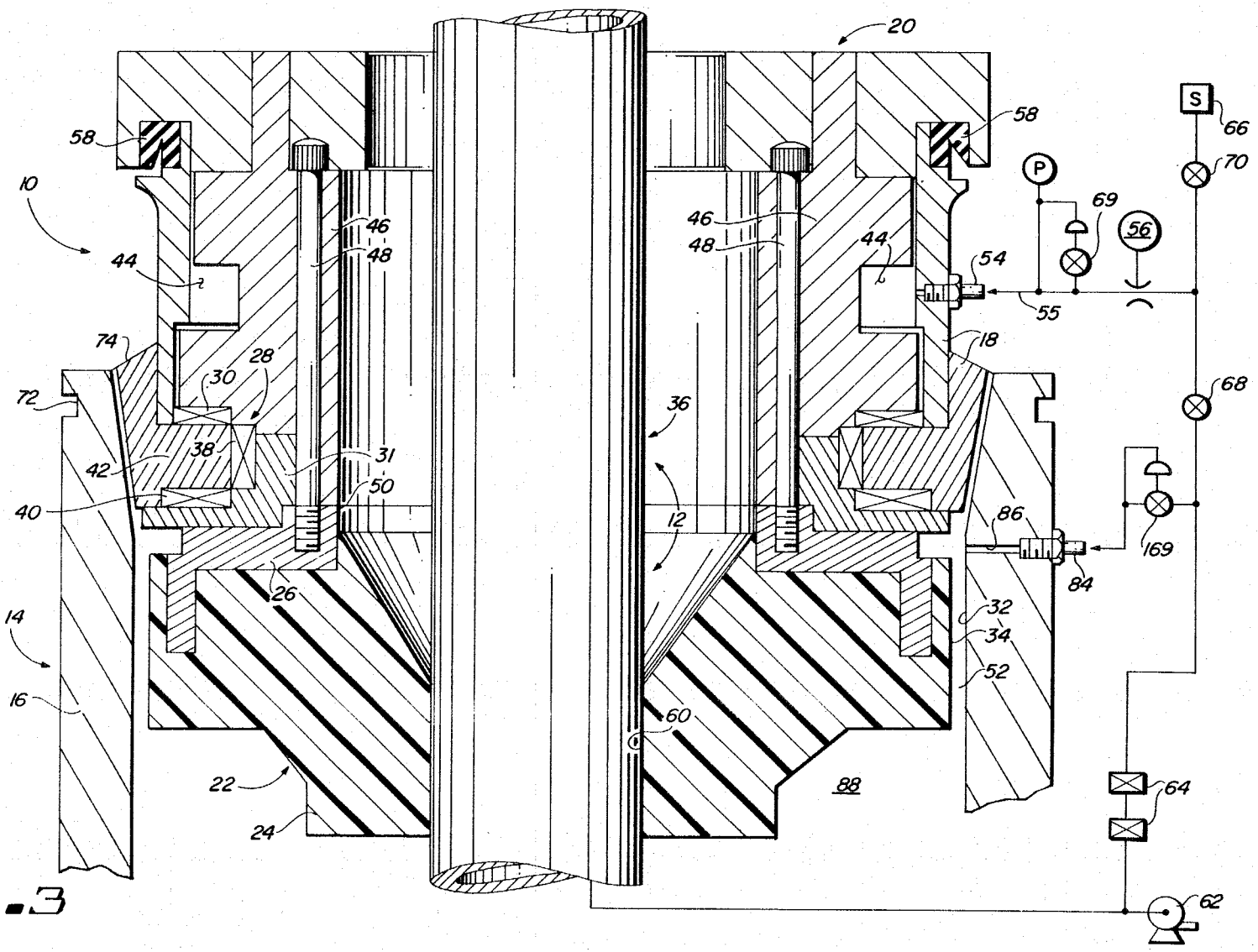
FIG. 3 is a fragmentary, part cross-section view of the present invention.

In the embodiment set forth in FIG. 3, the drilling fluid media which flows into the rotating member 36 is drilling mud, which is also connected to a filter 64. Clean drilling mud therefore flows through valve 68, through the illustrated orifice, through the pressure regulator valve 69, through conduit 55, into the connector 54, and into the chamber 44 where the fluid continues into the bearing chamber. A source of lubricant 56 is admixed with the drilling media to thereby replenish any lubricant that may be flushed from the bearing chamber. The bearing chamber is therefore maintained at a positive pressure dependent upon the set point of regulator 69.

At the same time, a second flow path of drilling media is provided by the pressure regulator 169 which is connected to fitting 84. The drilling media flows through the illustrated passageway 86 and into the interface 52 formed between the inside wall surface 32 of the main housing and the outer wall surface of the stripper rubber.

So long as there is flow of fluid along passageway 86, there can be no contamination at interface 52 as a result of ingress of debris from annular area 88.

It is considered within the comprehension of this invention to connect the interface 52 directly to the bearing chamber, as for example connecting the fittings 54 and 84 by a suitable flow conduit.

The prior art RBOP 10 preferably is made in accordance with my issued U.S. Pat. Nos. 4,441,551; 4,367,795; 4,208,056; 3,965,987; and 4,154,448; as well as the John Biffle U.S. Pat. No. 4,361,185; and my patent application Ser. No. 381,158 filed May 24, 1982.

Figure 4:
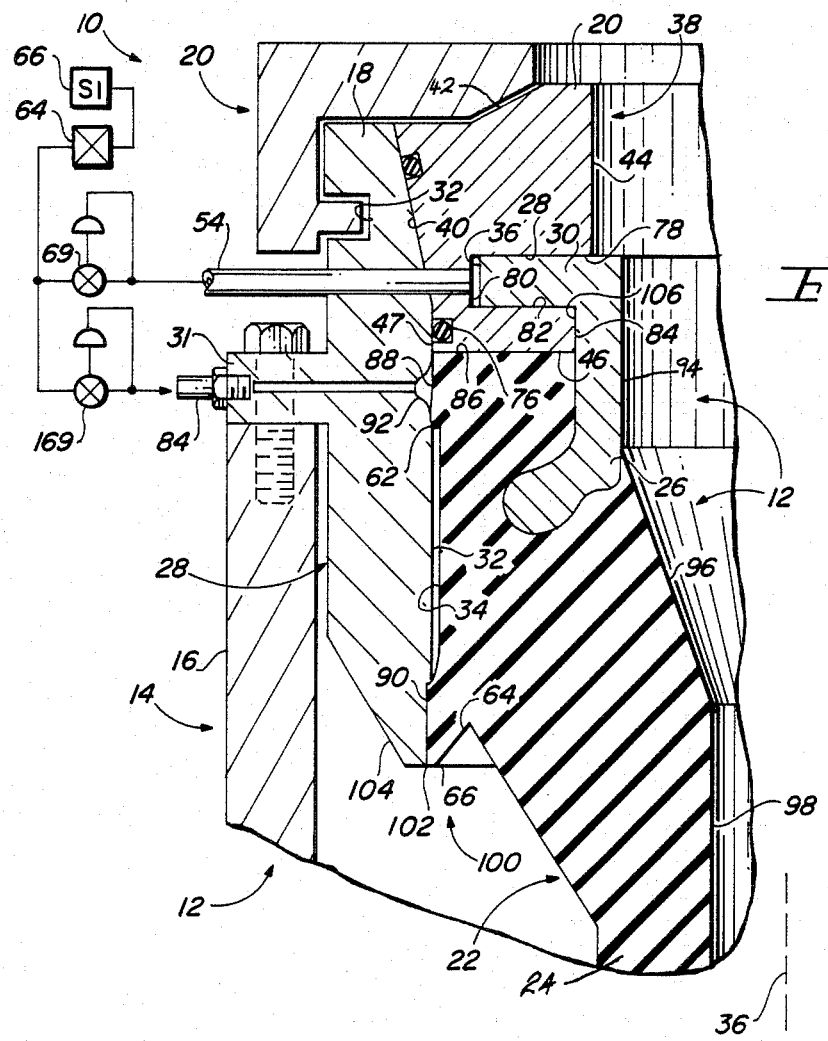
FIG. 4 is an enlarged, fragmentary, longitudinal, cross-sectional view of an RBOP made in accordance with the present invention; and, FIG. 5 is an enlarged, broken, top-plan view of an RBOP made in accordance with the present invention.
Figure 5:
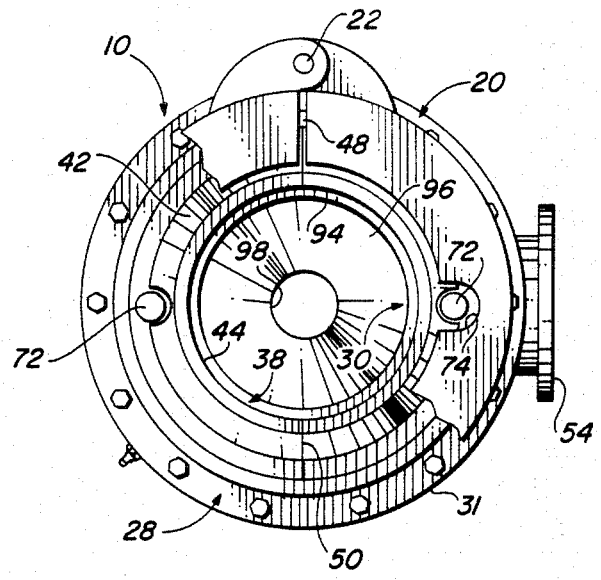

In the embodiment set forth in FIG. 4 of the drawings, a source of pressurized fluid at 66 flows through a commercially available filter 64, where the flow then branches at control valves 69 and 169, respectively; and, is made available at inlets 54 and 84, respectively. Further details of the RBOP of FIG. 4 are found in my copending patent application Ser. No. 381,158 filed May 24, 1982.

The filtered fluid from 66 therefore is available to flow into the bearing chamber formed by wall surfaces 78, 80, and 82; and into the intervening area presented by the realtively rotating surfaces 32 and 34, respectively, of the washpipe and rubber, respectively, with the rate of flow through the regulator or control valve 69, 169 being dependent upon the setting thereof.

I claim:

1. Improvements in RBOP, said RBOP having a main body; an outflow conduit leading from said main body, means for attaching said main body to the upper end of a wellbore casing; an axial passageway formed through said main body through which a rotating member can be telescopingly received;

an upwardly extending washpipe affixed to and forming part of said main body; a bearing housing supported by said main body; a rotating head assembly rotatably mounted at the upper end of said main body by journal means contained within said bearing housing; said rotating head assembly includes a stripper rubber assembly affixed thereto and positioned within said axial passageway; said stripper rubber assembly includes a stripper mount member, and a stripper rubber for sealingly engaging the washpipe; said axial passageway extends through said stripper assembly;

said stripper rubber has a large annular upper end attached to said mount member; and, a lower annular marginal end extending downwardly therefrom for sealingly engaging a rotating member which may extend therethrough;

said large upper annular end of the stripper rubber has an outer circumferentially extending wall surface which slidably engages the inner wall surface of the washpipe;

a lateral passageway formed through said main body, through said washpipe, and into the interface formed between the inner wall surface of the washpipe and the outer wall surface of the large upper annular end of the stripper rubber so that debris is precluded from entering the interface when a positive pressure is applied to the lateral passageway; and, means by which said lateral passageway can be connected to receive drilling media.

2. The improvement of claim 1 wherein there is further included another lateral passageway formed into said bearing housing;

and means by which said another lateral passageway can be connected to receive drilling media.

3. The improvement of claim 2 wherein the drilling media is connected to a filter means located upstream of said rotating member to remove debris from the drilling media.

4. The improvement of claim 3 wherein the drilling media is maintained at a positive pressure respective to the pressure measured within the housing upstream of the outflow pipe.

5. In an RBOP having a main body which can be connected to the upper extremity of a borehole; an axial passageway extending longitudinally through said main body through which a hollow rotating drive member can extend, a rubber stripper assembly, journal means contained within a bearing housing by which said stripper assembly is positioned in journaled relationship within said axial passageway; said axial passageway extends through said stripper assembly for nonrotatively receiving the drive member in sealed and slidable relationship therethrough so that the stripper assembly rotates about the longitudinal axial centerline thereof, and drilling media can flow down through the rotating drive member and into the borehole; the improvement comprising:

said rubber stripper assembly includes a rubber having a relatively large diameter annular upper end and a relatively small diameter annular lower end;

a medial inner circumferentially extending surface of said axial passageway of said main body receives the outer circumferentially extending surface of said upper end of said rubber thereagainst and thereby forms an interface therebetween; passageway means formed through said main body and connecting the interface formed between the rubber and the inner surface of the axial passageway with the drilling media so that the drilling media effects a positive pressure at the interface which exceeds the pressure of the returned fluid during a drilling operation.

6. The improvement of claim 5 wherein there is further included another passageway which is formed laterally through the main body and into said bearing housing;

and means by which said another passageway can be connected to receive drilling media.

7. The improvement of claim 5 wherein the drilling media is connected to a filter means located upstream of said rotating member to remove debris from the drilling media.

8. The improvement of claim 5 wherein there is further included another passageway means formed into said bearing housing;

and means by which said another passageway means can be connected to receive drilling media;

the drilling media is connected to a filter means 1 upstream of the passage means connected to said rubber of the rotating member to remove debris from the drilling media.

9. In a RBOP connected to the upper end of a cased borehole for receiving a driving member attached to the upper end of a drill string therethrough;

said RBOP includes a main body, a journal means disposed within a bearing chamber and supported by said main body; a stripper assembly, including a rubber attached thereto, rotatably supported by said journal means; said rubber has a large annular upper marginal end and a small lower annular marginal end extending therefrom for sealingly engaging the driving member;

the method of elongating the operational life of said RBOP according to the following steps:

(1) isolating said bearing chamber from debris returned uphole by the drilling media by placing a circumferentially extending outer surface area of said large annular upper marginal end of the rubber in sealing contact with a circumferentially extending inner surface area of the main housing at a location below said journal means;

(2) flowing drilling media from a location upstream of said driving member into the interface formed between the rubber and the inner surface of the main housing; and, (3) regulating the pressure of the drilling media at said interface whereby the pressure of the media at said interface is greater than the pressure of drilling media returned from the borehole.

10. The method of claim 9 wherein there is further included another lateral passageway formed into said bearing chamber;

and means by which said another lateral passageway can be connected to receive drilling media.

11. The method of claim 9 wherein the drilling media is series connected respective to a filter means located upstream of said rotating member to remove debris from the drilling media.

12. The method of claim 11 wherein a lubricant is admixed with the drilling media at a location upstream of the rotating member.

* * * * *

UNITED STATES PATENT AND TRADEMARK OFFICE

CERTIFICATE OF CORRECTION

PATENT NO. : 4,529,210

DATED : July 16, 1985

INVENTOR(S) : MORRIS S. BIFFLE

It is certified that error appears in the above-identified patent and that said Letters Patent is hereby corrected as shown below:

Column 2, line 54, substitute --flow-- for "low";

Column 7, line 15, substitute --located-- for numeral "l".

Signed and Sealed this

*Twenty-second* Day of *October 1985*

[SEAL]

*Attest:*

*Attesting Officer*

DONALD J. QUIGG

*Commissioner of Patents and Trademarks—Designate*